US006710281B1

(12) United States Patent
Wachnuk

(10) Patent No.: US 6,710,281 B1
(45) Date of Patent: Mar. 23, 2004

(54) LASER BASED HEAT EXCHANGER

(76) Inventor: Duane H. Wachnuk, 31 Alpaugh Crescent, Leduc (CA), T9E 5H2

( * ) Notice: Subject to any disclaimer, the term of this patent is extended or adjusted under 35 U.S.C. 154(b) by 0 days.

(21) Appl. No.: 10/326,519

(22) Filed: Dec. 20, 2002

(51) Int. Cl.[7] ..... B23K 26/00
(52) U.S. Cl. ..... 219/121.6
(58) Field of Search ..... 219/121.6, 121.61; 392/355, 375, 376, 491

(56) References Cited

U.S. PATENT DOCUMENTS

| | | | | |
|---|---|---|---|---|
| 2,462,746 A | * | 2/1949 | Inman | |
| 2,943,174 A | | 6/1960 | Parker | 219/10.47 |
| 3,495,406 A | | 2/1970 | Donatelli et al. | 60/108 |
| 4,142,088 A | | 2/1979 | Hirsch | 219/121 L |
| 4,152,567 A | | 5/1979 | Mayfield | 219/10.55 A |
| 4,171,089 A | | 10/1979 | Schossow | 237/55 |
| 4,389,560 A | | 6/1983 | Mitchell | 219/121 L |
| 4,511,777 A | | 4/1985 | Gerard | 219/10.51 |
| 4,658,115 A | | 4/1987 | Heath | 219/275 |
| 4,735,261 A | | 4/1988 | Huebner | 165/76 |
| 4,864,098 A | * | 9/1989 | Basanese | 219/121.61 |
| 5,511,145 A | * | 4/1996 | Bailey et al. | 392/355 |

FOREIGN PATENT DOCUMENTS

| | | | | |
|---|---|---|---|---|
| JP | 63-52785 A | * | 3/1988 | 219/121.61 |

* cited by examiner

*Primary Examiner*—Geoffrey S. Evans
(74) *Attorney, Agent, or Firm*—Sturm & Fix LLP

(57) ABSTRACT

A laser based heat exchange system (10) including a steel containment vessel (20) suspended within a framework member (50) having inner (52) and outer (51) framework sections provided with fluid restrictor panels (54) which force fluid flowing through a pipe or conduit containing the framework member (50) to pass between the inner framework section (52) and the outer surface of the containment vessel (20) having an inner lining (30) of ceramic files (31) which are heated by a laser beam (35) generated by a carbon dioxide laser (30) suspended within the containment vessel (20).

13 Claims, 1 Drawing Sheet

LASER BASED HEAT EXCHANGER

CROSS REFERENCE TO RELATED APPLICATIONS

Not applicable.

BACKGROUND OF THE INVENTION

1. Field of the Invention

The present invention relates to the field of heat exchange systems in general and in particular to a heat exchange system that employs a laser as the heat generating source.

2. Description of Related Art

As can be seen by reference to the following U.S. Pat. Nos. 4,142,088; 5,850,412; 4,152,567; and, 4,389,560, the prior art is replete with myriad and diverse heating systems employing a variety of different heat sources.

While all of the aforementioned prior art constructions are more than adequate for the basic purpose and function for which they have been specifically designed, they are uniformly deficient with respect to their failure to provide a simple, efficient, and practical heat exchange apparatus that is particularly well suited for remote locations having limited conventional fuel resources.

With the current concern regarding the dwindling reserves of fossil fuels worldwide, it has become imperative that alternative heating systems be developed to stave off as long as possible the ultimate depletion of our fossil fuel supply.

As a consequence of the foregoing situation, there has existed a longstanding need among conservationists and others for a new and improved heat exchange system which relies, at its core, upon a laser heat generating source; and, the provision of such an arrangement is the stated objective of the present invention.

BRIEF SUMMARY OF THE INVENTION

Briefly stated, the laser based heat exchange system that forms the basis of the present invention comprises in general a containment unit, a heat sink unit, a heat source and a mounting unit wherein, the heat source unit relies upon a laser member to generate heat within the heat sink unit that is convectively transferred to a fluid medium that passes through a duct or pipe containing the heat exchange system.

As will be explained in greater detail further on in the specification, the containment unit includes an elongated containment vessel the interior of which is provided with the heat sink unit including a heat sink liner member having a plurality of ceramic tiles covering the interior of the containment vessel; wherein, the heat source unit comprises a carbon dioxide laser member the barrel of which is directed toward one end of the containment vessel to heat the ceramic tiles and the periphery of the containment vessel by conduction.

In addition, the mounting unit includes a framework member having inner and outer framework sections that support and suspend the containment vessel in a generally perpendicular fashion relative to the framework member wherein, the framework member also includes a plurality of fluid restrictor panels that force fluid flow around the periphery of the heated containment vessel to elevate the temperature of the fluid.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
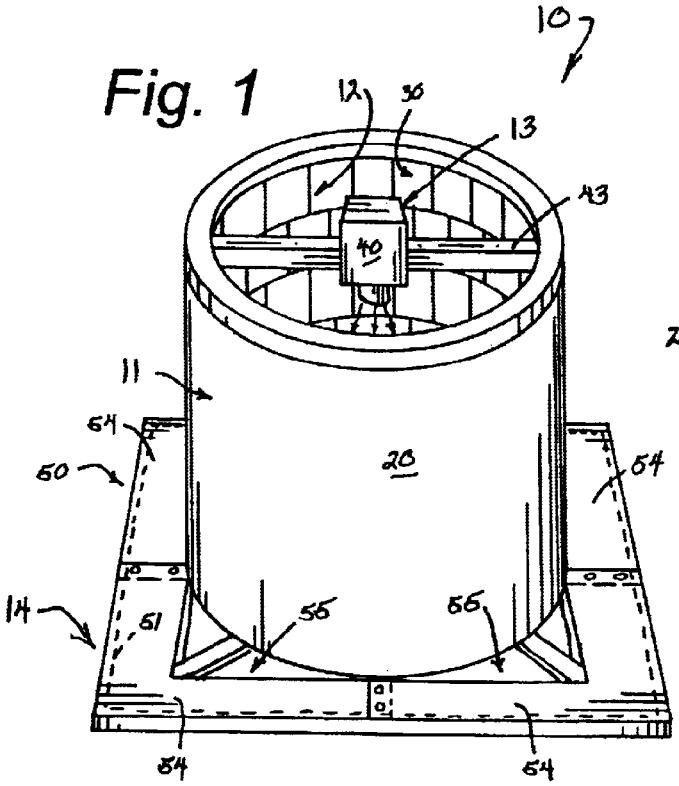
FIG. 1 is a perspective view of the laser based heat exchange apparatus that forms the basis of the present invention.

As can be seen by reference to the drawings, and in particular to FIG. 1, the laser based heat exchange system that forms the basis of the present invention is designated generally by the reference number 10. The system 10 comprises in general a containment unit 11 a heat sink unit 12 a heat source unit 13 and a mounting unit 14. These units will now be described in seriatim fashion.

Figure 2:
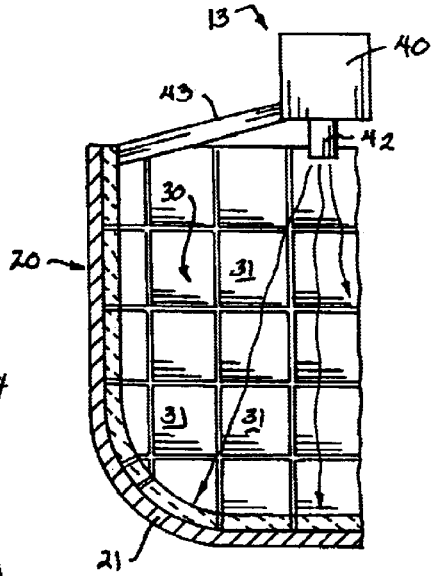
FIG. 2 is an isolated detail view of the containment unit, the heat source unit, and the heat sink unit.
Figure 3:
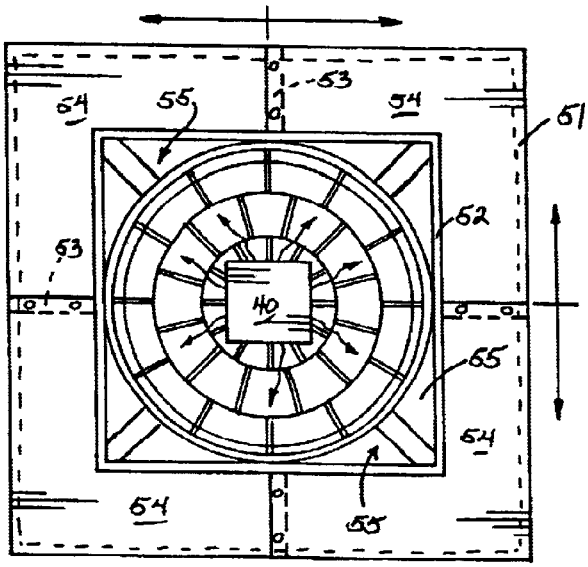
FIG. 3 is a top plan view of the heat exchange apparatus.

As shown in FIGS. 1 through 3, the containment unit 11 comprises in general a sealed generally elongated cylindrical containment vessel 20 preferably fabricated from ⅛" to ¼" steel 21 wherein, the containment vessel 20 is suspended within a pipe or duct (not shown) by the mounting unit 14 as will be explained in greater detail further on in the specification.

Turning now to FIGS. 1 through 4, it can be seen that the heat sink unit 12 comprises a heat sink liner member 30 fabricated from a plurality of uniform thickness ceramic tiles 31 wherein the average thickness of the ceramic tiles 31 is between ⅜" to 1".

Figure 4:
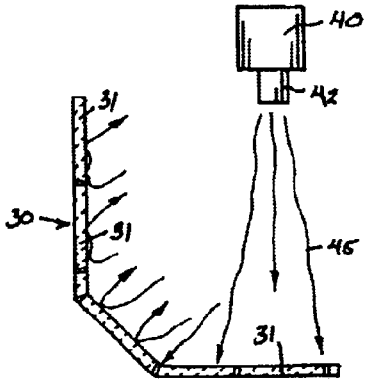
FIG. 4 is an isolated detail view of the heat source unit and the heat sink unit.

In addition, as shown in FIGS. 2 through 4, the heat source unit 13 comprises a carbon dioxide laser 40 suspended within the interior of the containment vessel from a framework 43 wherein the barrel 42 of the laser 40 is directed toward the ceramic tiles 31 on one end of the containment vessel 20 wherein, the ceramic tiles 31 impacted by the laser beam 45 convert the laser energy into heat which is transferred by conduction to the adjacent ceramic tiles 31 and the walls of the containment vessel 20.

As can be seen by reference to FIGS. 1 and 3, the mounting unit 14 comprises a mounting framework 50 having an outer generally rectangular frame section 51 and an inner generally rectangular frame section 52 connected to one another by a plurality of cross-braces 53 wherein the inner frame section 52 and the cross-braces 53 cooperate with one another to captively engage and suspend the containment vessel 20 within the mounting unit 14 whereby the longitudinal axis of the containment vessel 20 is aligned generally perpendicular to the plane of the mounting framework 50.

In addition, as shown in FIGS. 1 and 3, the mounting framework is further provided with a plurality of fluid restrictor panels 54 that concentrate the fluid flow through openings 55 formed between the inner frame section 52 and the outer periphery of the heated containment vessel 20 where the fluid passing around the containment vessel 20 absorbs heat from the containment vessel 20 via convection in a well recognized manner.

At this juncture, it should be appreciated that the heat exchange system 10 of this invention only requires a source of electricity to power the carbon dioxide laser 40 to effect the heat exchange process and this electricity can be generated in many remote or even outer space environs having little or no readily available fuel sources via solar energy thereby virtually eliminating the need for fossil fuels.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A heat exchange system comprising:

a containment unit including a generally elongated containment vessel;

a heat sink unit including a heat sink liner member fabricated from a plurality of ceramic tiles that cover the interior of the containment vessel;

a heat source unit including a laser member suspended within the containment unit by a framework element wherein the laser member has a barrel that is directed toward one end of the containment vessel.

2. The system as in claim 1; wherein, said containment vessel is fabricated from metal.

3. The system as in claim 1; wherein, said containment vessel is fabricated from steel.

4. The system as in claim 3, wherein, the thickness of the containment vessel ranges from between ⅛" to ¼".

5. The system as in claim 4; wherein the thickness of the liner member ranges between ⅜" to 1".

6. The system as in claim 1 further comprising:

a mounting unit for suspending the containment vessel within a fluid supply line wherein the mounting unit includes an outer framework section operatively associated with an inner framework section that is disposed in a surrounding relationship with the containment vessel.

7. The system as in claim 6; wherein, the mounting unit further includes:

a plurality of fluid restrictor panels disposed intermediate the inner and outer framework sections.

8. The system as in claim 7; wherein, the mounting unit further Includes a first plurality of cross braces that operatively connect the outer framework section to the inner framework section.

9. The system as in claim 8; wherein, the containment vessel has a longitudinal axis that is disposed generally perpendicular to the plane of the mounting framework member.

10. The system as in claim 5; a mounting unit for suspending the containment vessel within a fluid supply line wherein the mounting unit includes an outer framework section operatively associated with an inner framework section that is disposed in a surrounding relationship with the containment vessel.

11. The system as in claim 10; wherein, the mounting unit further includes:

a plurality of fluid restrictor panels disposed intermediate the inner and outer framework sections.

12. The system as in claim 11; wherein, the mounting unit further includes a first plurality of cross braces that operatively connect the outer framework section to the inner framework section.

13. The system as in claim 12; wherein, the containment vessel has a longitudinal axis that is disposed generally perpendicular to the plane of the mounting framework member.

* * * * *